US010156202B2

(12) United States Patent
Wagner et al.

(10) Patent No.: US 10,156,202 B2
(45) Date of Patent: Dec. 18, 2018

(54) BARRIER RING AND ASSEMBLY FOR A CYLINDER OF AN OPPOSED-PISTON ENGINE

(71) Applicant: ACHATES POWER, INC., San Diego, CA (US)

(72) Inventors: Bryant A. Wagner, Santee, CA (US); Patrick R. Lee, San Diego, CA (US); Abhishek Sahasrabudhe, San Diego, CA (US)

(73) Assignee: ACHATES POWER, INC., San Diego, CA (US)

( * ) Notice: Subject to any disclaimer, the term of this patent is extended or adjusted under 35 U.S.C. 154(b) by 514 days.

(21) Appl. No.: 15/060,933

(22) Filed: Mar. 4, 2016

(65) Prior Publication Data

US 2017/0254288 A1 Sep. 7, 2017

(51) Int. Cl.
*F02F 1/22* (2006.01)
*F02F 1/24* (2006.01)
(Continued)

(52) U.S. Cl.
CPC ..... *F02F 1/24* (2013.01); *F02B 75/282* (2013.01); *F02B 77/04* (2013.01); *F02F 1/22* (2013.01);
(Continued)

(58) Field of Classification Search
CPC ..... F02F 1/24; F02F 2001/249; F02F 7/0009; F02F 1/22; F02B 75/282; F02B 75/28; F02B 77/04; F02B 25/08
See application file for complete search history.

(56) References Cited

U.S. PATENT DOCUMENTS 1,231,903 A 7/1917 Junkers
1,410,319 A 3/1922 Junkers
(Continued)

FOREIGN PATENT DOCUMENTS

DE 3038235 A1 5/1982
DE 10 2006 060330 A1 6/2008
(Continued)

OTHER PUBLICATIONS

International Search Report for PCT/US2016/022599, dated May 27, 2016.
(Continued)

*Primary Examiner* — Jacob Amick
(74) *Attorney, Agent, or Firm* — Terrance A. Meador; Julie I. Muyco

(57) ABSTRACT

A barrier ring for a cylinder assembly for an opposed-piston engine fits into a groove fashioned into a portion of the cylinder liner that is adjacent to the top dead center location of the end surfaces of the pistons, in a volume of the cylinder liner that defines the combustion chamber. The barrier ring and groove are part of a barrier assembly that prevents heat generated during combustion from reaching the outer wall of the cylinder assembly, reducing the need for conventional cooling systems and increasing the amount of heat retained in the combustion chamber. The barrier assembly allows for increased engine efficiency because of the combustion heat retained in the combustion chamber, as well as a reduction in the overall size of the engine because of the reduction in engine cooling needed.

21 Claims, 10 Drawing Sheets

(51) Int. Cl.
*F02B 75/28* (2006.01)
*F02B 77/04* (2006.01)
*F02F 1/42* (2006.01)

(52) U.S. Cl.
CPC ..... *F02F 1/4285* (2013.01); *F02B 75/28* (2013.01); *F02F 2001/249* (2013.01); *F02F 2200/00* (2013.01)

(56) References Cited

U.S. PATENT DOCUMENTS

| | | | | |
|---|---|---|---|---|
| 1,495,326 | A | 5/1924 | Junkers | |
| 2,144,706 | A | 1/1939 | Raul | 123/51 |
| 2,423,395 | A | 7/1947 | Lieberherr | 123/41.79 |
| 2,446,841 | A | 8/1948 | Lieberherr | 123/193 |
| 2,624,328 | A | 1/1953 | Grinham et al. | 123/193 |
| 2,703,077 | A | 3/1955 | Antonsen | 123/193 |
| 2,805,654 | A | 9/1957 | Jacklin | 123/51 BA |
| 2,998,808 | A | 9/1961 | Jackson | 123/41.72 |
| 3,084,678 | A | 4/1963 | Lindsay | 123/51 |
| 5,086,734 | A | 2/1992 | Nakai | 123/65 |
| 5,553,585 | A | 9/1996 | Paro | 123/193.2 |
| 5,582,144 | A | 12/1996 | Mizutani | 123/193.2 |
| 7,360,511 | B2 | 4/2008 | Lemke | 123/41.35 |
| 7,438,038 | B2 | 10/2008 | Azevedo et al. | 123/193.2 |
| 8,413,632 | B2 | 4/2013 | Sand | 123/193.2 |
| 8,485,147 | B2 | 7/2013 | Liu et al. | 123/51 |
| 8,539,918 | B2 | 9/2013 | Lemke et al. | 123/52.2 |
| 8,851,029 | B2 | 10/2014 | Callahan et al. | 123/46 |
| 8,935,998 | B1 | 1/2015 | Tebbe | 123/51 |
| 9,051,902 | B2 | 6/2015 | Jones et al. | F02M 25/0722 |
| 9,121,365 | B1 | 9/2015 | Wagner | F02F 1/004 |
| 9,435,290 | B2 | 9/2016 | Fuqua | |
| 9,482,153 | B2 * | 11/2016 | Bethel | F02B 75/282 |
| 2005/0279296 | A1 | 12/2005 | Coney et al. | 123/41.84 |
| 2008/0150237 | A1 | 6/2008 | Bischofberger et al. | 277/310 |
| 2009/0241770 | A1 | 10/2009 | Blythe et al. | 92/260 |
| 2012/0186561 | A1 | 7/2012 | Bethel et al. | 123/51 |
| 2013/0025548 | A1 | 1/2013 | Liu et al. | 123/41.17 |
| 2013/0199503 | A1 | 8/2013 | Callahan et al. | 123/51 |
| 2016/0032861 | A1 | 2/2016 | Fuqua | F02F 7/0009 |
| 2016/0069293 | A1 | 3/2016 | McClearen et al. | F02F 1/004 |
| 2016/0097340 | A1 | 4/2016 | Morgan et al. | F02F 1/004 |
| 2016/0252043 | A1 | 9/2016 | McClearen et al. | F02F 1/004 |
| 2016/0290277 | A1 | 10/2016 | Koszewnik et al. | 123/51 |

FOREIGN PATENT DOCUMENTS

| | | | |
|---|---|---|---|
| EP | 0684411 | A1 | 11/1995 |
| GB | 851353 | A | 10/1960 |
| JP | 62038459 | | 3/1987 |
| JP | 03021546 | | 3/1991 |
| WO | WO-2005/003527 | A2 | 1/2005 |
| WO | WO-2005/003532 | A1 | 1/2005 |
| WO | WO-2013/158107 | A1 | 10/2013 |
| WO | WO-2015/038425 | A1 | 3/2015 |
| WO | WO-2016/160340 | A1 | 10/2016 |

OTHER PUBLICATIONS

"Inconel® alloy 625", Special Metals Corporation, (Aug. 13, 2013), downloaded from the Internet on Mar. 3, 2016, at <www.specialmetals.com>.

Third-Party Pre-Issuance Submission in U.S. Appl. No. 15/050,707.

International Search Report dated May 11, 2017, for PCT application PCT/US2017/018978.

* cited by examiner

BARRIER RING AND ASSEMBLY FOR A CYLINDER OF AN OPPOSED-PISTON ENGINE

RELATED APPLICATIONS

This disclosure includes material related to the disclosure of the following commonly-owned US Patent Applications: U.S. patent application Ser. No. 13/136,402; filed Jul. 29, 2011, now U.S. Pat. No. 8,485,147; U.S. patent application Ser. No. 13/385,127, filed Feb. 2, 2012, now U.S. Pat. No. 8,851,029; U.S. patent application Ser. No. 14/255,756, filed Apr. 17, 2014, now U.S. Pat. No. 9,121,365; pending U.S. patent application Ser. No. 14/675,340, filed Mar. 31, 2015; and pending U.S. patent application Ser. No. 14/732,496, filed Jun. 5, 2015.

FIELD

The field includes opposed-piston engines. More particularly, the field relates to a barrier assembly, which includes a barrier ring, for a cylinder assembly constructed to reduce heat rejection from the cylinder assembly in an opposed-piston engine.

BACKGROUND

Construction of an opposed-piston engine cylinder assembly is well understood. The cylinder assembly includes a liner (sometimes called a "sleeve") retained in a cylinder tunnel formed in a cylinder block. The liner includes a bore and longitudinally displaced intake and exhaust ports, machined or formed in the liner near respective ends thereof. Each of the intake and exhaust ports includes one or more circumferential arrays of openings in which adjacent openings are separated by a solid portion of the cylinder wall (also called a "bridge"). An intermediate portion of the liner exists between the intake and exhaust ports. In an opposed-piston engine, two opposed, counter-moving pistons are disposed in the bore of a liner with their end surfaces facing each other. At the beginning of a power stroke, the opposed pistons reach respective top dead center (TDC) locations in the intermediate portion of the liner where they are in closest mutual proximity to one another in the cylinder. During a power stroke, the pistons move away from each other until they approach respective bottom dead center (BDC) locations in the end portions of the liner at which they are furthest apart from each other. In a compression stroke, the pistons reverse direction and move from BDC toward TDC.

The intermediate portion of the cylinder lying between the intake and exhaust ports bounds a combustion chamber defined between the end surfaces of the pistons when the pistons are near their TDC locations. This intermediate portion bears the highest levels of combustion temperature and pressure that occur during engine operation. The presence of openings for engine components such as fuel injectors, valves, and/or sensors in the intermediate portion diminishes the cylinder assembly's strength and makes the cylinder liner vulnerable to cracking, particularly through the fuel injector and valve openings.

Heat loss through the cylinder liner is a factor that degrades engine performance throughout the operating cycle of an opposed-piston engine. Combustion occurs as fuel is injected into air compressed between the piston end surfaces when the pistons are in close mutual proximity, forming the combustion chamber. Loss of the heat of combustion through the liner reduces the amount of energy available to drive the pistons apart in the power stroke. By limiting this heat loss, fuel efficiency would be improved, heat rejection to coolant would be reduced, and higher exhaust temperatures can be realized. Smaller cooling systems and lower pumping losses are just some of the benefits of limiting heat loss through the cylinder assembly. It is therefore desirable to retain as much of the heat of combustion as possible within the cylinder assembly.

An opposed-piston cylinder assembly construction according to the present disclosure satisfies the objective of heat containment, thereby allowing opposed-piston engines to operate higher heat retention than opposed-piston engines of the prior art.

SUMMARY

The highest concentration of heat in an opposed-piston engine cylinder assembly occurs in the annular portion of the cylinder liner between the top dead center (TDC) locations of the pistons, where combustion takes place. Nearly half of the total heat flux into the liner occurs in this annular portion. Accordingly, construction of a barrier ring for insertion into the cylinder liner in such a manner as to yield a high thermal resistance will reduce heat flux through the annular liner portion.

In some implementations, provided herein is a barrier assembly that includes a barrier ring, a groove adjacent to the portion of the cylinder liner near the combustion chamber, and a space or gap between the barrier ring and the back wall of the groove. The combustion chamber is partially defined by a first end surface on a first piston and a second end surface on a second piston when the first and second pistons are near their top dead center positions in the cylinder assembly. In a related aspect, provided herein is a barrier ring for use in the barrier assembly. The barrier ring includes an open-ended tube with a wall defining a volume inside the tube. The tube includes a first and a second set of openings in the wall, in which the first set of openings allows for communication between engine hardware and the combustion chamber, and the second set of openings allows for pressure equalization between two volumes separated by the barrier ring. Methods of making and using the barrier ring and barrier assembly are also provided herein.

DETAILED DESCRIPTION

Figure 1A:
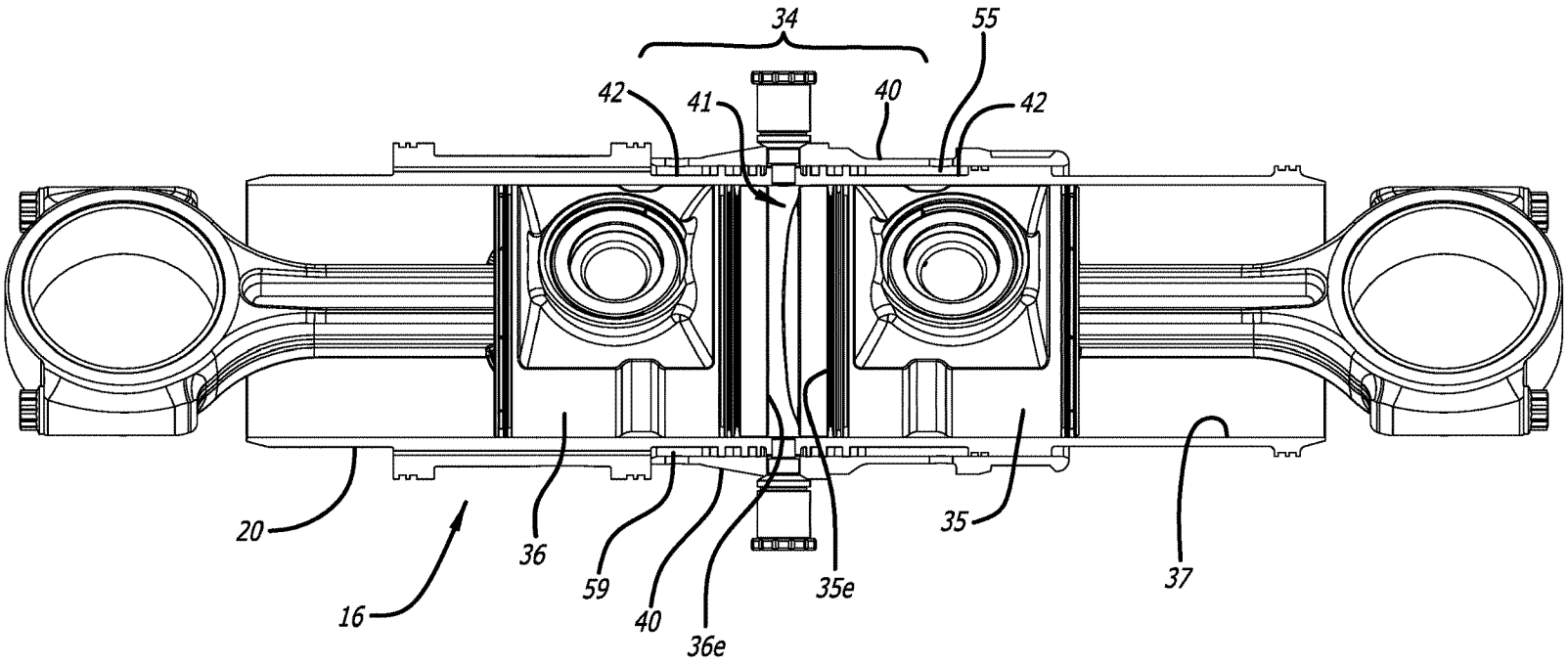
FIG. 1A shows a cross-section of a portion of a cylinder assembly from an opposed-piston engine with a compression sleeve and pistons received in a liner.
Figure 1B:
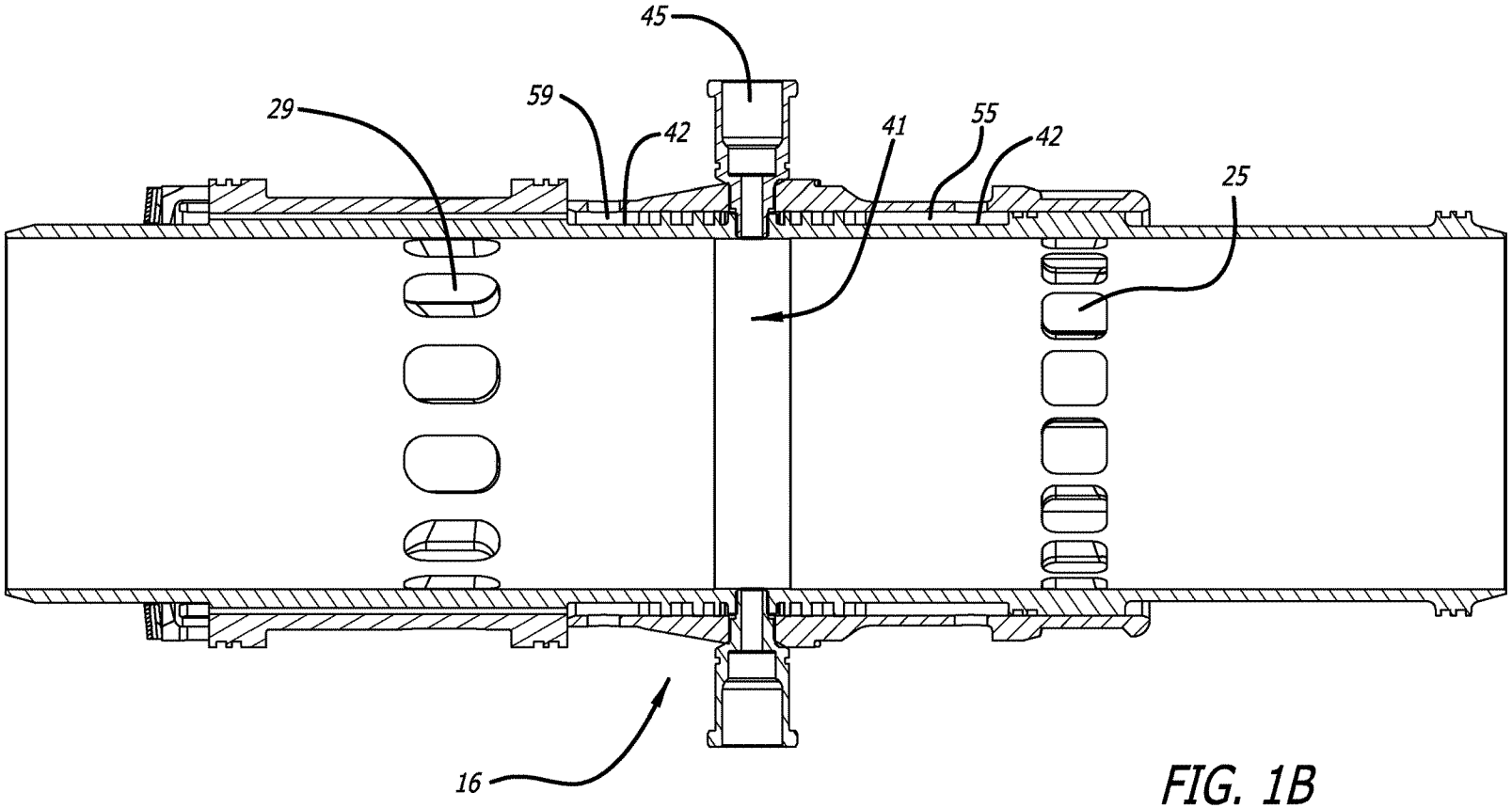
FIG. 1B shows the outer portion of the cylinder assembly of FIG. 1A.

FIGS. 1A and 1B show an exemplary cylinder assembly for use in an opposed-piston engine. The cylinder assembly 16 includes a liner 20, intake ports 25, exhaust ports 29, an external surface of the liner 42, a compression sleeve 40, and a bore 37. Two pistons 35 and 36 are disposed within the bore 37. The pistons 35 and 36 have end surfaces, 35*e* and 36*e*, respectively, that partially define the combustion chamber 41 when the pistons 35, 36 are at or near their respective top dead center (TDC) positions. The combustion chamber 41 is also partially defined by the cylinder liner 20 in the intermediate portion 34 of the cylinder. The intermediate portion 34 is located between the intake ports 25 and the exhaust ports 29. Located in the intermediate portion 34, at the periphery of the combustion chamber 41, are openings into which fuel injection components 45 and other engine components can fit. This exemplary cylinder assembly is described in detail in related U.S. patent application Ser. No. 14/675,340.

The compression sleeve 40 is formed to define generally cylindrical space between itself and the external surface 42 of the liner through which a liquid coolant may flow in an axial direction from near the intake ports toward the exhaust ports. The intermediate portion 34 is reinforced by the compression sleeve 40, as described in greater detail in U.S. patent application Ser. No. 14/675,340, and cooling fluid is circulated in the compression sleeve 40 in generally annular spaces 55 and 59. The cooling fluid that circulates in these generally annular spaces 55, 59 flows to other components of the opposed-piston engine, not shown in FIGS. 1A and 1B, that allow for heat to dissipate from the cooling fluid to the surrounding environment, such as a radiator.

Figure 2A:
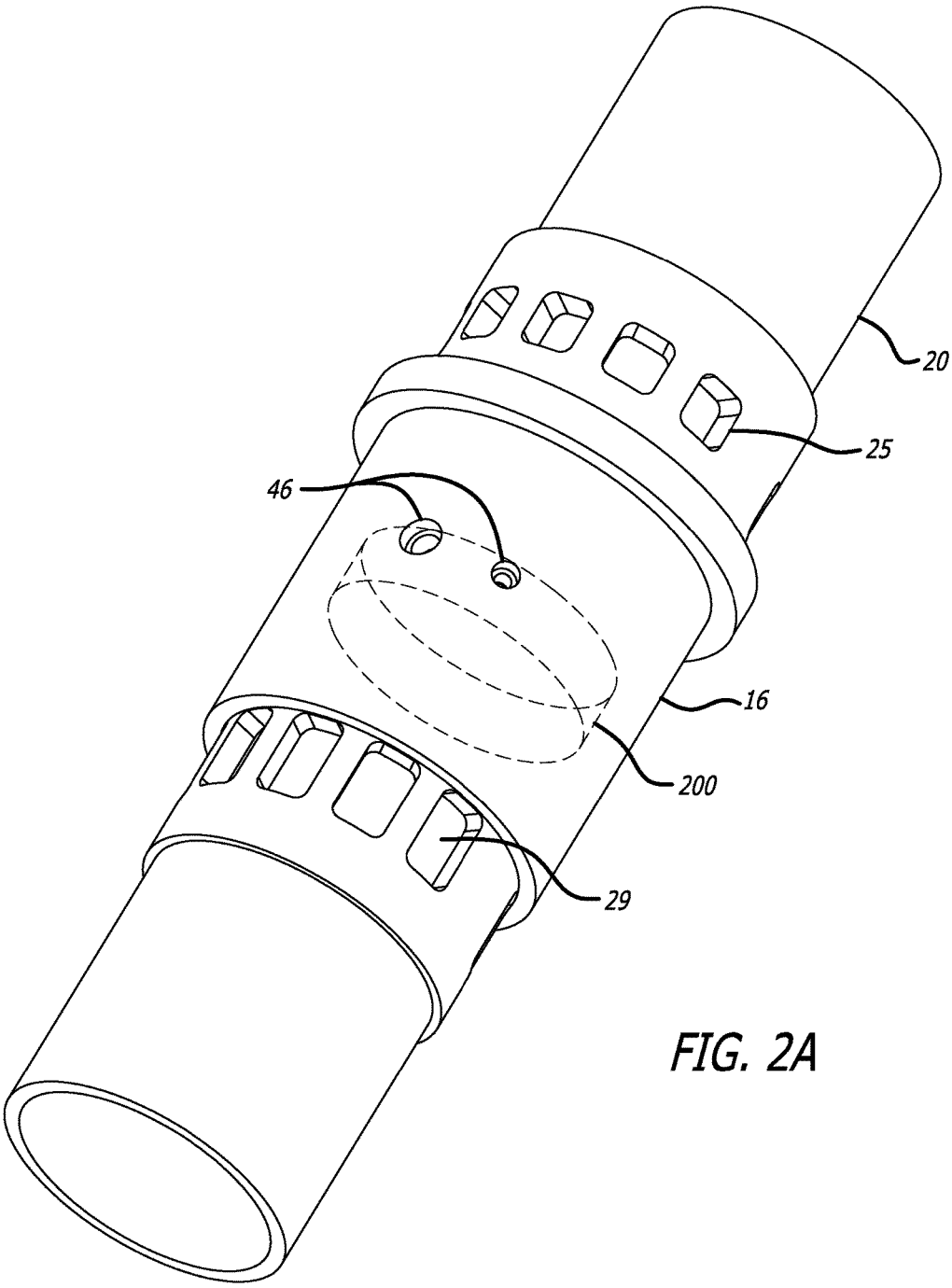
FIG. 2A is a three dimensional view of a portion of a cylinder liner with an installed barrier ring shown in shadow.
Figure 2B:
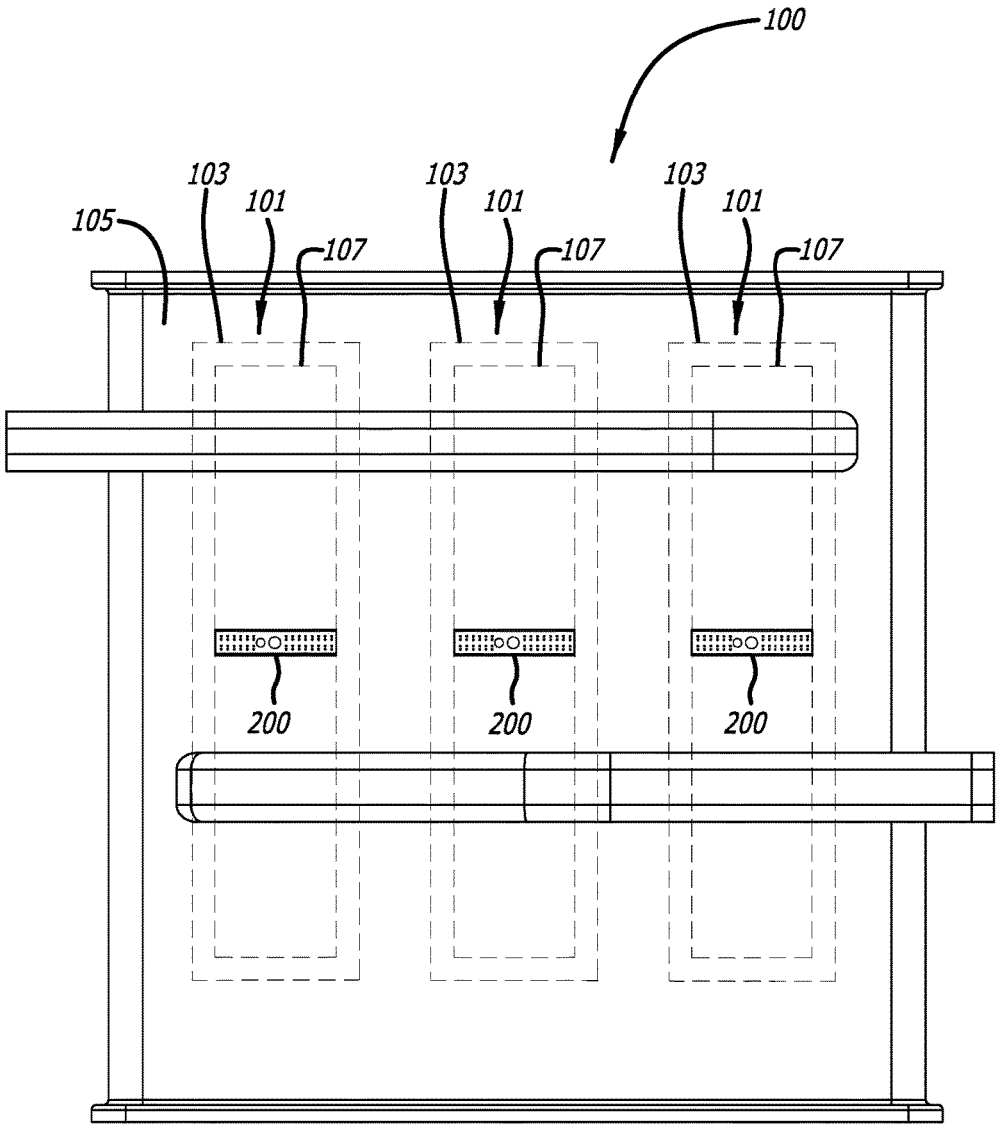
FIG. 2B is a schematic drawing of an opposed-piston engine with one or more cylinder assemblies according to this specification.

FIG. 2A is a three dimensional view of a portion of a cylinder liner 20 with a barrier ring 200 installed. The barrier ring 200 is shown in shadow. The barrier ring 200 is located in the intermediate portion 34, overlapping with the portion of the intermediate portion that includes one or more openings 46 for injection components, as well as the portion of the intermediate portion that encircles the combustion chamber. FIG. 2B illustrates an opposed-piston engine 100 with three cylinder assemblies 101, in which each cylinder comprises a cylinder tunnel 103 in a cylinder block 105 and a cylinder liner 107 (reference number 20 in FIGS. 1A-1B) according to this specification seated in the cylinder tunnel. Of course, the number of cylinders is not meant to be limiting. In fact, the engine 100 may have fewer, or more, than three cylinders. Each cylinder assembly 101 has a barrier ring 200 installed in the intermediate portion of the cylinder assembly 101. The barrier ring 200 is shown in shadow, as in FIG. 2A.

The barrier ring 200 discussed herein is a part of a barrier assembly (e.g., a heat barrier assembly) that is inserted into, or located in, the bore of a cylinder assembly and that prevents heat incident upon the barrier ring from the combustion chamber from passing to other parts of the opposed-piston engine. The barrier ring can be thin compared to the walls of the cylinder assembly, and numerous openings, perforations, or holes, can be present in the ring. The materials of the barrier ring, barrier ring shape, openings in the barrier ring, and combination of the barrier ring with insulation or air gaps influence the ability of the barrier assembly to keep heat from escaping to other volumes in the engine.

Figure 3:
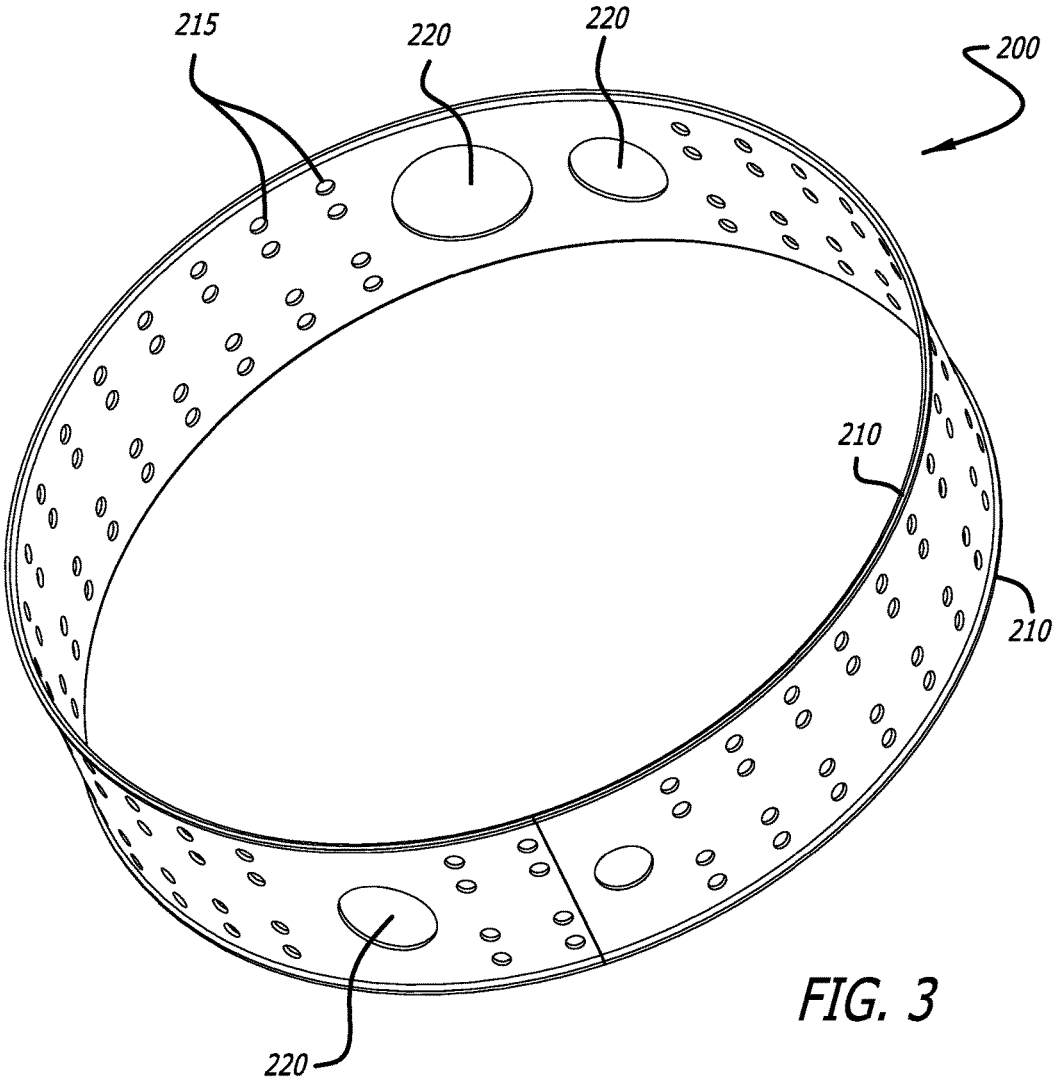
FIG. 3 is a three-dimensional drawing of the barrier ring prior to installation into the cylinder bore.

FIG. 3 is a three-dimensional drawing of an exemplary barrier ring 200 (e.g., heat screening ring) prior to installation into the cylinder bore. The barrier ring 200 is a thin-walled tube or ring with folded edges 210, openings 220 for communication between injection/combustion hardware and the combustion chamber, and openings 215 to allow for pressure equalization between the space inside and the cylinder environment outside of the barrier ring 200. The barrier ring 200 sits in a circumferential groove on the inside of the cylinder liner. The groove is located at, or adjacent to, the combustion chamber. The barrier ring 200 is formed so that the folded edges 210 allow the inside surface of the barrier ring 200 to lie substantially flush with inside wall of the cylinder liner when inserted into the groove. The barrier ring 200 and the circumferential groove, along with a gap between the ring and groove back wall, are part of a barrier assembly.

Figure 4A:
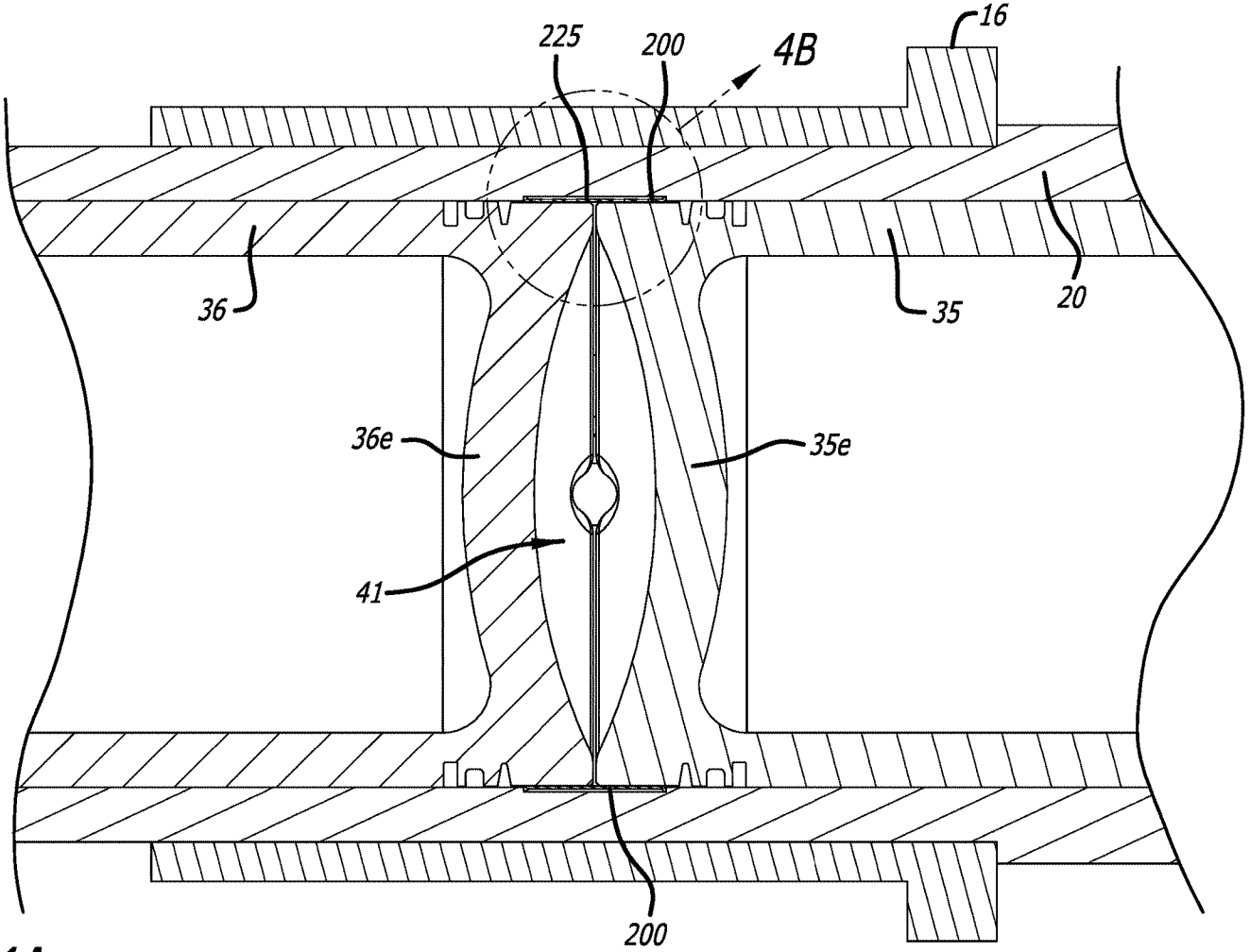
FIG. 4A is a cross sectional view of a portion of the cylinder assembly and engine block with the opposing pistons at TDC and the barrier assembly.
Figure 4B:
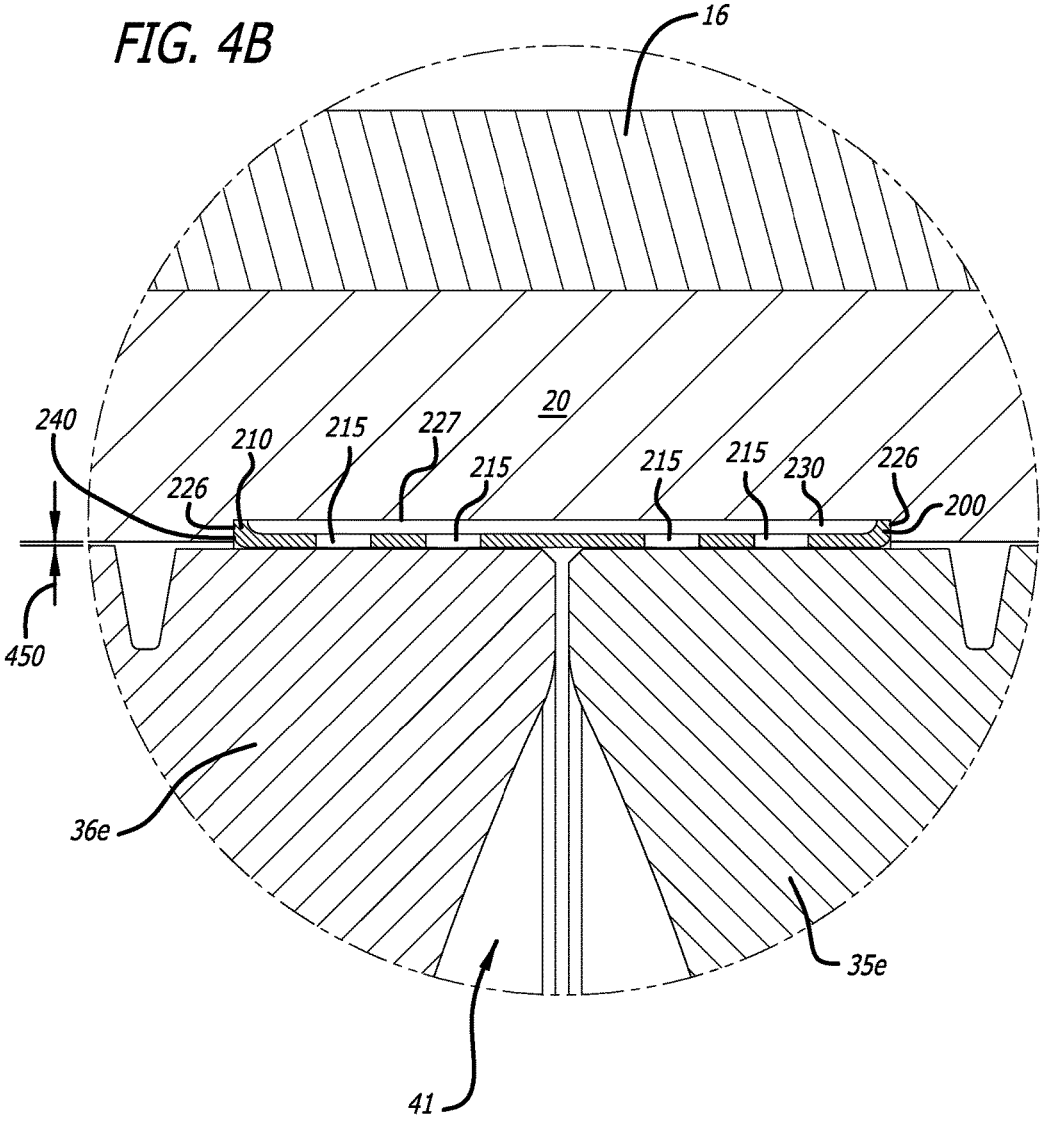
FIG. 4B is an exploded partial view of the cylinder assembly and pistons of FIG. 4A.

FIG. 4A is a cross sectional view of a portion of the cylinder assembly 16 and engine block with the opposing pistons 35, 36 at TDC, forming the combustion chamber 41, and with the barrier ring 200 installed into a groove 225, as described above. The barrier ring 200 has a width that is approximately the height of the combustion chamber 41, as measured along the central axis of the cylinder, from one piston end surface 36*e* to another piston end surface 35*e*. FIG. 4B is an exploded partial view of the cylinder sleeve and pistons of FIG. 4A that shows the barrier assembly, including the groove 225 and the barrier ring 200, in greater detail. The openings 215 in the barrier ring for equalizing pressure between the gap 230 in the groove 225 and the combustion chamber 41 are also shown in FIG. 4B. The gap 230 helps to prevent the flow of heat away from the combustion chamber 41. In FIG. 4B, the barrier ring 200 is situated in the groove 225 and is shown as flush with the sides 226 of the groove; the folded edges 210 of the barrier ring 200 are up against the groove sides 226. The main portion of the barrier ring, the barrier ring wall that includes the openings 215, is spaced away from the back wall 227 of the groove 225 by the folded edges 210 of the barrier ring. The barrier ring 200 may have the configuration shown in FIG. 4B after the engine has warmed up and the barrier ring 200 has expanded. When the engine is cold, there can be a clearance of between 10 microns and 100 microns in the interface 240 between the groove sides 226 and the folded edges 210 of the barrier ring. In some implementations, the clearance in a cold engine between the groove sides 226 and the edges 210 of the barrier ring can be less than 10 microns, or alternatively, the clearance can be 100 microns or greater. Alternatively, or additionally, the material at or around the groove sides 226 can be compliant enough or be constructed to accommodate any expansion of the barrier ring 200 in the axial direction of the cylinder assembly 16.

In most engines, a circumferential clearance space between pistons and the inner wall of the cylinder liner is provided to allow for thermal expansion. After long hours of operation carbon builds up in this clearance space, on the top land of a piston, which can result in increased friction and ring wear; at worst it can cause ring jacking. It is preferable that carbon removal not occur where the ports are located. Carbon debris near the ports can contaminate charge air entering the bore or be swept into the gas stream exiting the cylinder assembly after combustion, degrading the performance of the engine.

In the configuration shown in FIGS. 4A and 4B, the barrier ring 200 is shown as contacting the pistons 35, 36 and bridging the gap 450 between the cylinder bore and the sides of the pistons 35, 36. By protruding beyond the groove 225, the barrier ring 200 can contact and scrape the sidewalls of the pistons 35, 36 as the pistons approach and/or leave TDC in the cylinder. This contacting and scraping can remove carbon buildup on the sidewalls of the pistons 35, 36 while avoiding the possibility of fouling incoming air with the scraped carbon or adding to exhaust emissions.

Alternatively, in some implementations, the barrier ring 200 may be flush with the sides 226 of the groove when the engine is cool. When the engine warms up, the barrier ring 200 can bow away from the cylinder liner, into the combustion chamber. The bowing portion of the barrier ring can rub against the sidewalls of the pistons 35, 36 as the pistons move through the cylinder, toward or away from TDC. In such implementations, the clearance in the interface 240 between the barrier ring edge and groove sidewall when the engine is cold, discussed above, may or may not be present.

Figure 4C:
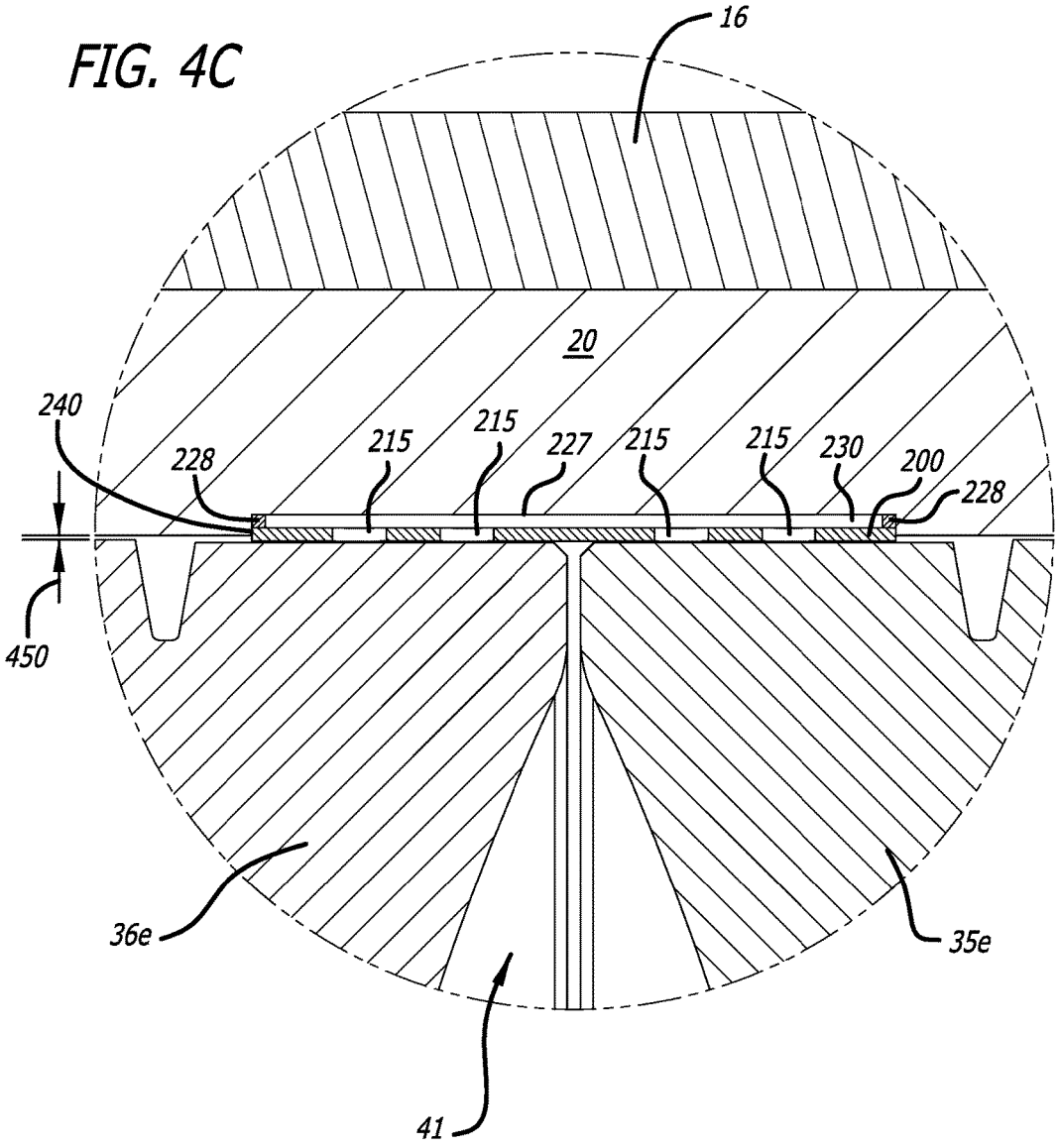
FIG. 4C is a variation of the cylinder assembly and barrier assembly shown in FIG. 4B.

FIG. 4C shows an alternate configuration for the barrier ring 200 and groove 225. The barrier ring 200 shown in FIG. 4C lacks folded edges, and the barrier ring 200 and back wall 227 of the groove 225 are separated by a spacer 228. The spacer 228 is shown as a pair of ledges that protrude from the groove sidewalls 226 and back wall 227. This spacer 228 replaces the folded edges 210 of the barrier ring shown in FIG. 4B. The clearance between the barrier ring 200 and the groove sidewall 226 at the interface between the two 240, when the engine is cold, could have the characteristics of the clearance discussed with respect to the configuration shown in FIG. 4B. A barrier ring 200 with folded edges 210 could be used with a liner whose groove 225 includes a spacer 228, however, doing so may lead to a configuration in which the barrier ring 200 protrudes too far into the volume of the cylinder, and not only scrapes the top lands of the pistons, but may in fact hinder the movement of the pistons.

In any case, whether the spacer 228 is present as a ledge, as in FIG. 4C, or as folded edges 210 of the barrier ring, or in some other fashion, the barrier ring 200 is separated from the back wall 227 of the groove 225 by a distance ranging from about 0.5 mm to about 3 mm. In some implementations, the gap separating the barrier ring from the back wall of the groove can be about 0.5 mm to about 2.5 mm, such as about 0.75 mm to about 2 mm, including about 1.0 mm to about 1.5 mm.

The barrier ring 200 can be made from any suitable material that can withstand repeated exposure to the temperatures and pressures experienced in the combustion chamber, as well as that can quickly dissipate heat. In some implementations, the material used to make the barrier ring will be different from the material used to form the cylinder liner or bore. Suitable materials for the barrier ring include high temperature nickel-chromium-based alloys such as Inconel®, a cobalt-chromium alloy such as Stellite® Alloy 6, stainless steel, and the like. The thickness of the barrier ring 200 is selected, along with the material used to fabricate the barrier ring and the pattern of openings made in the barrier ring, so that the barrier ring 200 is robust enough to withstand mechanical failure when exposed to the temperatures and pressures of the cylinder assembly interior while the engine is running. The thickness of the barrier ring can range from about 0.5 mm to about 3.0 mm, such as from about 1.0 mm to about 2.5 mm, including from about 1.0 mm to about 2.0 mm.

As described above, openings in the barrier ring can allow engine components to contact the interior of the combustion chamber and/or allow for equalization in pressure between the volumes in the cylinder that are separated by the barrier ring. The barrier ring is sized to fit into a groove in the bore of a cylinder liner where the combustion chamber is formed when the pistons are near their TDC positions. Together the barrier ring and the groove, including the space between the barrier ring and back wall of the groove, form the barrier assembly that prevents heat loss from the combustion chamber to the surrounding cylinder assembly and engine.

The openings in the barrier ring that allow engine components to reach into the combustion chamber can be located where fuel injection nozzles, compression release engine breaking valves, and sensors project from the cylinder into the combustion chamber (e.g., 46 in FIG. 2A). These pressure-equalizing openings (e.g., 220 in FIG. 3) are sized to just allow engine components (e.g., nozzles and sensors) through; openings that are too large are undesirable, as will be explained further below. The barrier ring is then about 2 mm-20 mm wider (taller) than the diameter of the largest opening. In some implementations, the barrier ring has a height about 4.0 mm to about 20.0 mm wider than the diameter of the largest opening in the barrier ring wall, including a height about 2.0 mm to 4.0 mm wider than the diameter of the largest opening, about 5.0 mm to about 20.0 mm wider than the diameter of the largest opening, about 6.0 mm to about 19.0 mm, about 7.0 mm to about 18.0 mm, and about 8.0 mm to about 16.0 mm wider than the diameter of the largest opening in the barrier ring wall.

There are various possible configurations for the openings in the barrier ring that are meant to allow for equalization in pressure between the spaces on either side of the barrier ring (e.g., 215 in FIG. 3). These openings allow for movement of gas between the space in the combustion chamber enclosed by the barrier ring and the gap between the barrier ring and the cylinder liner in the groove. This allows for equalization of pressure, which in turn prevents excessive deformation of the barrier ring due to high mechanical stresses. While larger openings will allow for rapid equalization of pressure across the barrier ring, openings that are too large will not provide the heat screening properties that are desired. Openings that are too large will allow heat to escape through the cylinder liner and the rest of the cylinder assembly, while openings that are too small will lead to inequality in pressure across the ring and in turn mechanical stresses in, and deformation of, the barrier ring.

The size and shape of all of the openings in the barrier ring are optimized to achieve maximum heat-loss reduction while maintaining an acceptable pressure difference across the barrier ring. Pressure-equalizing openings can have any shape, such as circular, elliptical, triangular, rectangular, square, slit-like, and the like. Fillets can be used to eliminate stress concentration in the barrier ring. The arrangement of pressure-equalizing openings can vary to maximize heat-loss reduction and pressure equalization across the barrier ring. Groupings of pressure-equalizing openings can be used to vary the density of the openings. In some implementations, the selected opening locations can produce a ring with no pressure-equalizing openings along the center, or midline, of the barrier ring. Alternatively, the selected opening locations can produce a barrier ring with openings exclusively along the midline of the ring, or a barrier ring with openings along the midline and off the midline of the ring. Also, the location of the openings can be targeted to a particular angular pitch (e.g., frequency of openings along the ring). The angular pitch of the pressure-equalizing openings can be between 30° and 45°. Pressure-equalizing openings can be located randomly or have a definite pattern.

These openings can all have similar sizes and shapes, or the sizes and shapes of the pressure-equalizing openings can vary, so long as the barrier ring maximizes the heat-loss reduction of the cylinder while minimizing mechanical stresses in the ring that can cause failure.

In general, the total surface area of the barrier ring can be made up of between 1% and 5% openings. In some implementations, the barrier ring can have a surface area that is less than 1% openings. In some implementations, openings can make up 5% or more of the surface area of the barrier ring.

Figure 5A:
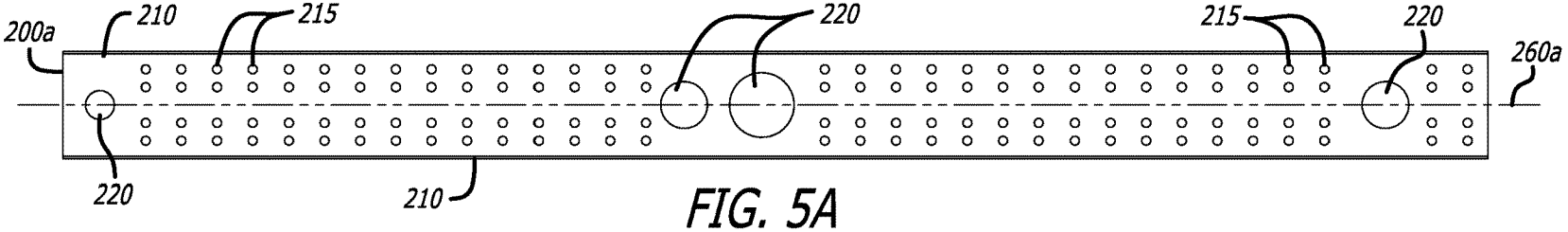
FIGS. 5A-5C are three exemplary configurations of a barrier ring, with the ring laid out flat prior to installation in the cylinder bore.
Figure 5B:
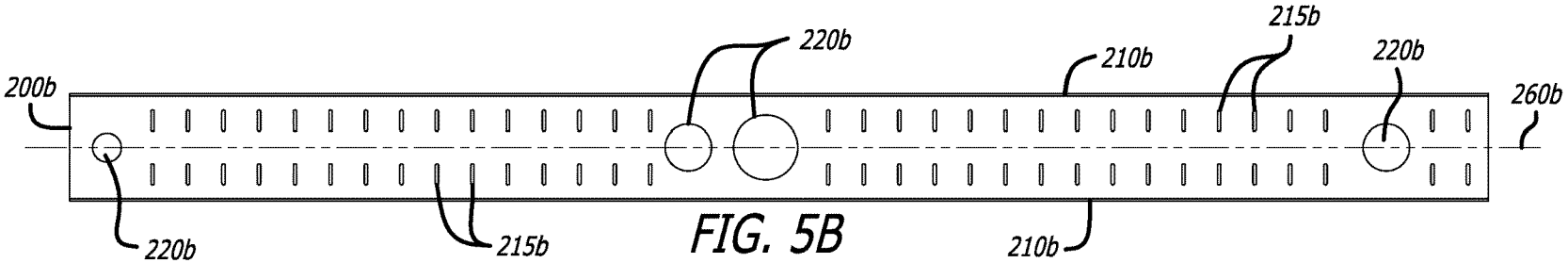
Figure 5C:
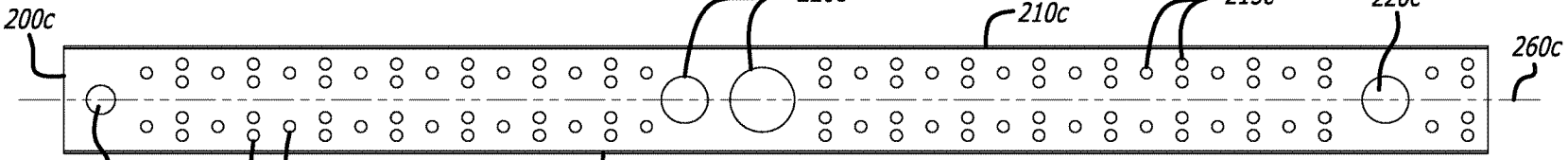

FIGS. 5A-5C show exemplary barrier ring configurations with the barrier ring laid out flat prior to installation in the cylinder bore. FIG. 5A is a barrier ring 200 with folded edges 210, openings for injection nozzles and other components 220, and pressure-equalizing openings 215. In the barrier ring shown in FIG. 5A, the pressure-equalizing openings 215 are circular and are grouped so that these types of openings are not located along the midline 260*a* of the ring. FIG. 5B shows a barrier ring 200*b* with folded edges 210*b*, openings for injection nozzles and other components 220*b*, and slit-like pressure-equalizing openings 215*b*. The slit-like openings 215*b* are spaced evenly in pairs on either side of the midline 260*b* of the ring. FIG. 5C shows a barrier ring 200*c* with folded edges 210*c*, openings for engine components 220*c*, and circular pressure-equalizing openings 215*c*. Like the slit-like openings 215*b*, the circular openings 215*c* are located in a pattern that avoids placing any openings 215*c* along the midline 260*c* of the barrier ring. The openings 215*c* are grouped in alternating pairs and single openings. As described above, though the barrier ring configurations shown in FIGS. 5A-5C do not have openings along the midline of the rings, in some implementations, the barrier rings can include openings along the midline.

Though FIG. 2 shows the barrier ring 200 as a continuous ring, with the ends, as shown in FIGS. 5A-5C, adhered to each other, the ends may actually not be sealed or adhered. This can facilitate installation of the barrier ring 200 into the cylinder liner, as well as to allow for changes in the dimensions of the ring with changes in temperature in the cylinder assembly. The barrier ring 200 can be fabricated as a strip of material, as shown in FIGS. 5A-5C, with the openings and folded edges machined or cast into the material. The strip of material can then be worked to conform to a certain radius of curvature. The radius of curvature can be equal to that of the groove or slightly larger, to that when the barrier ring 200 is placed into the groove 225, the barrier ring 200 pushes against the edges of the groove and is secured into place. Alternatively, the barrier ring 200 can be fabricated without folded edges, and the barrier ring can hold a radius of curvature worked into it because the ring is sufficiently thick. Barrier rings without folded edges can maintain a gap in the groove, between the ring and the cylinder liner, by using a spacer, such as a lip or step (i.e., a ledge 228 in FIG. 4C) in the groove that supports the edges of the barrier ring and keeps the edges away from the back wall of the groove.

Additionally, or alternatively, cylinder assemblies for opposed-piston engines that use liners with a barrier ring can be used in conjunction with pistons that each have a barrier layer at their end surface. The barrier layer at the end surface of such pistons can allow for higher temperatures to be reached in the combustion chamber without diminishing performance. Such a combination of pistons with a heat-loss preventing barrier layer and the cylinder assemblies described herein can allow for reductions in conventional thermal management systems, better engine efficiency, and/or reductions in emission levels.

During a combustion event in an opposed-piston engine, a first piston and a second piston will move in a cylinder assembly, through the bore of an annular cylinder liner, in a direction along the long axis of the cylinder liner, from bottom dead center (BDC) towards top dead center (TDC). As the first and second pistons move axially, and both pistons are near their top dead center locations, they will eventually create a combustion chamber between their end surfaces. The air that is in the cylinder assembly between the end surfaces of the pistons heats up as the pistons move towards each other to form the combustion chamber. Fuel is injected into the combustion chamber, and the fuel mixes with the heated air. Combustion takes place between the end surfaces of the first and second pistons, releasing heat and creating pressure. The pressure pushes the first and second pistons apart. A barrier assembly, including a barrier ring as described herein and a groove in the cylinder liner, that is located inside the bore of the annular cylinder liner, on the periphery of the combustion chamber (e.g., between the TDC locations in the bore for the first and second pistons) prevents some of the combustion heat from reaching the outside of the cylinder assembly.

Cylinder assemblies for opposed-piston engines that use liners with barrier ring, as described herein, can be used with conventional thermal management systems to dissipate heat lost through the cylinder walls. By using cylinder liners with a barrier ring, as described above, the conventional cooling systems may not have to dissipate as much heat from cylinder assembly, around the combustion chamber. As a result of this, the cooling systems can be smaller in size, resulting in an overall more compact and efficient engine.

Example 1

Figure 6:
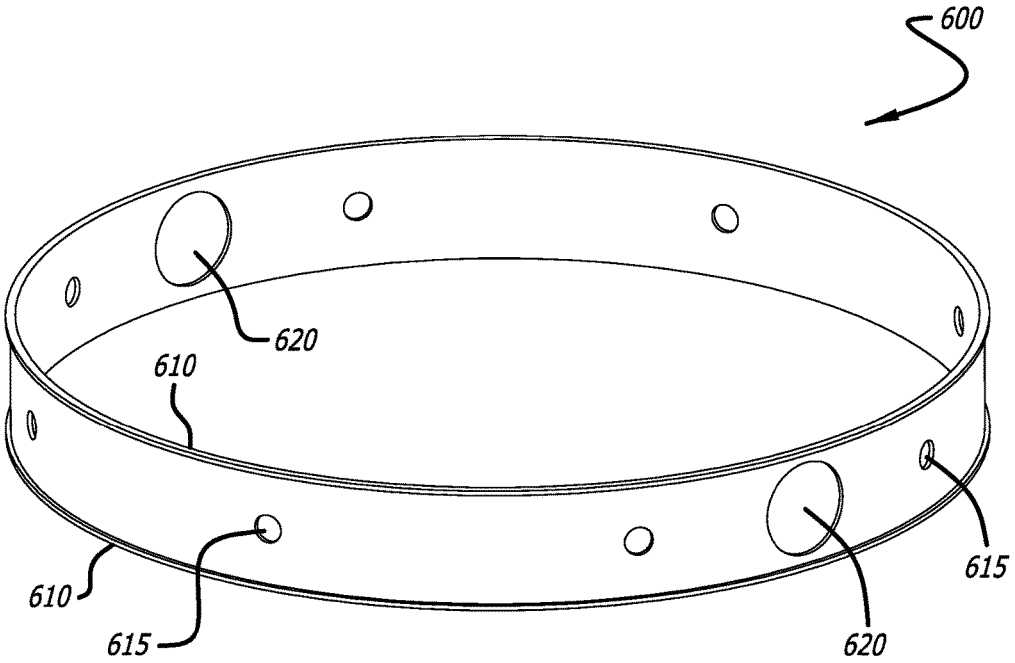
FIG. 6 shows an exemplary barrier ring for use in a cylinder assembly.

FIG. 6 shows an exemplary barrier ring 600 for a cylinder liner of an opposed piston engine. The barrier ring 600 fits into a groove in a cylinder liner. The cylinder liner for which the barrier ring is made has a 98.25 cm internal diameter. The barrier ring 600 has pressure-equalizing openings 615 of 2.5 mm diameter and 45° angular pitch that are formed along the centerline of the barrier ring. The barrier ring 600 also has folded edges 610 and has openings 620 to allow for nozzles injecting fuel into the combustion chamber that is surrounded by the barrier ring 600.

The scope of patent protection afforded these and other barrier ring embodiments that accomplish one or more of the objectives of durability and thermal resistance of an opposed-piston engine according to this disclosure are limited only by the scope of any ultimately-allowed patent claims.

What is claimed is:

1. A barrier ring for a cylinder assembly of an opposed-piston engine, comprising:

an open-ended tube with a wall defining a volume inside the tube, the tube comprising:

wall edges configured to contact side walls in a groove in a cylinder bore;

a first set of openings in the wall for communication between engine hardware and a combustion chamber, the combustion chamber partially defined by a first end surface on a first piston and a second end surface on a second piston when the first and second pistons are near respective top dead center positions in the cylinder bore; and a second set of openings in the wall, the second set of openings configured to allow for pressure equalization across the tube, between the volume inside the tube and a volume outside the tube, wherein the tube has a height of about 2 mm to about 20 mm more than a diameter of a largest opening of the first set of openings.

2. The barrier ring of claim 1, further comprising folded wall edges.

3. The barrier ring of claim 1, wherein the second set of openings comprises circular, elliptical, triangular, rectangular, and/or square shaped openings.

4. The barrier ring of claim 1, wherein the second set of openings have a circular pitch between 30° and 45°.

5. A cylinder assembly of an opposed-piston engine, comprising:

the barrier ring of claim 1;

a groove in a bore of the cylinder assembly, the groove positioned at the periphery of a combustion chamber that is partially defined by a first end surface on a first piston and a second end surface on a second piston when the first and second pistons are near their top dead center positions in the cylinder assembly in the opposed-piston engine, the groove comprising opposed side walls and a back wall; and a spacer configured to maintain the wall of the barrier ring from contacting the back wall of the groove.

6. The cylinder assembly of claim 5, wherein the spacer comprises a pair of ledges protruding from the sidewalls and back wall of the groove.

7. The cylinder assembly of claim 5, wherein the spacer comprises folded wall edges on the barrier ring.

8. The cylinder assembly of claim 5, further comprising intake ports and exhaust ports, in which the intake ports and exhaust ports are longitudinally displaced on either side of the groove.

9. A method for making a barrier ring for a cylinder assembly in an opposed-piston engine, the method comprising:

forming a strip of material with a length about equal to a circumference of a cylinder bore, the strip of material comprising:

a first set of openings configured for communication between engine hardware and a combustion chamber, the combustion chamber partially defined by a first end surface on a first piston and a second end surface on a second piston when the first and second pistons are near their top dead center positions in the cylinder assembly in the opposed-piston engine; and a second set of openings configured to allow for pressure equalization across the strip of material when the material separates at least two volumes; and working the strip of material to have a radius of curvature equal to or slightly greater than a groove in the cylinder assembly, wherein the strip of material has a height 2 mm to 20 mm greater than a diameter of a largest opening of the first set of openings.

10. The method of claim 9, further comprising forming folded edges of the strip of material, the folded edges being parallel to the length of the strip of material.

11. The method of claim 9, wherein the second set of openings comprises circular, elliptical, triangular, rectangular, and/or square shaped openings.

12. The method of claim 9, wherein the second set of openings have a circular pitch between 30° and 45°.

13. A method for using a cylinder assembly in an opposed-piston engine, the method comprising:

situating a first piston and a second piston in the cylinder assembly, the cylinder assembly comprising:

a cylinder tunnel; and a cylinder liner, comprising:

a bore;

longitudinally intake ports and exhaust ports;

an intermediate portion located between the intake ports and exhaust ports;

a groove located in the bore, in the intermediate portion, and positioned at the periphery of a combustion chamber that is partially defined by a first end surface on the first piston and a second end surface on the second piston when the first and second pistons are near their top dead center positions in the cylinder in the opposed-piston engine, the groove comprising opposed side walls and a back wall; and a barrier ring comprising:

an open-ended tube with a wall defining a volume inside the tube, the tube comprising:

wall edges configured to contact side walls in a groove in the cylinder liner;

a first set of openings in the wall for communication between engine hardware and the combustion chamber; and a second set of openings in the wall, the second set of openings configured to allow for pressure equalization across the tube, between the volume inside the tube and a volume outside the tube, wherein the tube has a height of about 2 mm to about 20 mm more than a diameter of a largest opening of the first set of openings;

moving the first and second pistons toward each other in the cylinder assembly in a compression stroke, creating the combustion chamber;

injecting fuel into the combustion chamber; and preventing heat from combustion of fuel in contact with compressed air in the combustion chamber from moving through the cylinder.

14. The method of claim 13, wherein the preventing comprises insulating the cylinder assembly in the location of the groove by having air or an insulating material in a gap between the barrier ring and the back wall of the groove in the cylinder liner.

15. The method of claim 13, further comprising scraping top lands of the first piston and the second piston as the pistons move through the cylinder assembly to towards their top dead center positions to form the combustion chamber.

16. A method for reducing heat loss in an opposed-piston engine, comprising:

moving a pair of pistons disposed in opposition in a bore of a cylinder liner of the opposed-piston engine;

in which the motion of a first piston of the pair of opposed pistons is in an axial direction of the cylinder liner between a first bottom dead center (BDC) position and a first top dead center (TDC) position;

in which the motion of a second piston of the pair of opposed pistons is in an axial direction of the cylinder between a second bottom dead center (BDC) position and a second top dead center (TDC) position;

combusting a mixture of air and fuel between end surfaces of the first and second pistons when the first and second pistons are near the first and second TDC positions during a compression stroke of the engine;

preventing loss of heat from the combustion with a barrier ring embedded in the bore between the first and second TDC positions; and equalizing pressure across the barrier ring.

17. The method of claim 16, wherein the barrier ring is embedded in a groove in the bore, further wherein between an edge of the barrier ring and a sidewall of the groove, there is a clearance of between 10 microns and 100 microns when the engine is cold.

18. A method for thermal management in a cylinder liner of an opposed-piston engine, comprising:

causing combustion of a mixture of fuel and air between the end surfaces of a pair of pistons disposed in the cylinder liner of the opposed-piston engine when the pistons are near respective top dead center locations in an annular liner portion of the cylinder liner between the respective top dead center locations; and, impeding flow of heat into the cylinder liner with a barrier ring embedded in the annular liner portion; and equalizing pressure across the barrier ring.

19. The method of claim 18, wherein the barrier ring comprises:

a first set of openings in the barrier ring for communication between engine hardware and a combustion chamber defined by the end surfaces of the pair of pistons disposed in the cylinder liner; and a second set of openings in the barrier ring, the second set of openings configured to allow for pressure equalization across the barrier ring.

20. The method of claim 19, wherein the second set of openings comprises circular, elliptical, triangular, rectangular, and/or square shaped openings.

21. The method of claim 19, wherein the second set of openings have a circular pitch between 30° and 45°.

* * * * *